US006559581B2

(12) United States Patent
Derraa

(10) Patent No.: US 6,559,581 B2
(45) **Date of Patent: *May 6, 2003**

(54) FIELD EMISSION ARRAYS AND ROW LINES THEREOF

(75) Inventor: Ammar Derraa, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/108,973

(22) Filed: Mar. 28, 2002

(65) Prior Publication Data

US 2002/0121850 A1 Sep. 5, 2002

Related U.S. Application Data

(63) Continuation of application No. 09/260,405, filed on Mar. 1, 1999, now Pat. No. 6,369,497.

(51) Int. Cl.[7] ..... H01J 1/30; H01J 1/02; H01J 1/62

(52) U.S. Cl. ..... 313/309; 313/336; 313/495

(58) Field of Search ..... 313/309, 310, 313/311, 336, 351, 422, 495, 496, 497; 315/169.1, 169.3; 445/24, 46, 35

(56) References Cited

U.S. PATENT DOCUMENTS

| | | | | |
|---|---|---|---|---|
| 5,229,331 A | | 7/1993 | Doan et al. | |
| 5,372,973 A | | 12/1994 | Doan et al. | |
| 5,585,301 A | | 12/1996 | Lee et al. | |
| 5,712,534 A | | 1/1998 | Lee et al. | |
| 5,762,773 A | | 6/1998 | Rasmussen | |
| 5,767,619 A | | 6/1998 | Tsai et al. | |
| 5,773,927 A | | 6/1998 | Zimlich | |
| 5,866,979 A | | 2/1999 | Cathey, Jr. et al. | |
| 5,975,975 A | | 11/1999 | Hofmann et al. | |
| 6,008,063 A | | 12/1999 | Derraa | |
| 6,064,149 A | | 5/2000 | Raina | |
| 6,124,665 A | * | 9/2000 | Derraa | 313/309 |
| 6,369,497 B1 | * | 4/2002 | Derraa | 313/309 |
| 6,373,174 B1 | * | 4/2002 | Talin et al. | 313/309 |

* cited by examiner

*Primary Examiner*—Nimeshkumar D. Patel
*Assistant Examiner*—Karabi Guharay
(74) *Attorney, Agent, or Firm*—TraskBritt

(57) ABSTRACT

A method of fabricating row lines and pixel openings of a field emission array. The method employs only two masks. A first mask employed in the method includes apertures alignable between rows of pixels of the field emission array. Electrically conductive material and semiconductive material exposed through the apertures are removed to define the row lines of the field emission array. A passivation layer is then disposed over at least selected portions of the field emission array. Then a second mask, including apertures alignable over the pixel regions of the field emission array, is disposed over the passivation layer of the field emission array. Passivation material exposed through the apertures of the second mask is removed to define openings through the passivation layer and over the pixel regions of the field emission array. Conductive material exposed through the apertures of the second mask may then be removed to expose the underlying semiconductive grid and to further define the pixel openings.

20 Claims, 11 Drawing Sheets

FIELD EMISSION ARRAYS AND ROW LINES THEREOF

CROSS-REFERENCE TO RELATED APPLICATION

This application is a continuation of application Ser. No. 09/260,405, filed Mar. 1, 1999, now U.S. Pat. No. 6,369,497 issued Apr. 9, 2002.

This invention was made with Government support under Contract No. ARPA-95-42 MDT-00061 awarded by Advanced Research Projects Agency (ARPA). The Government has certain rights in this invention.

BACKGROUND OF THE INVENTION

Field of the Invention: The present invention relates to methods of fabricating row lines over a planarized semiconductive grid of a field emission array. Particularly, the present invention relates to row line fabrication methods that employ only two masks to define row lines and pixel openings therethrough.

Related Art: Typically, field emission displays ("FEDs") include an array of pixels, each of which includes one or more substantially conical emitter tips. The array of pixels of a field emission display is typically referred to as a field emission array. Each of the emitter tips is electrically connected to a negative voltage source by means of a cathode conductor line, which is also typically referred to as a column line.

Another set of electrically conductive lines, which are typically referred to as row lines or as gate lines, extends over the pixels of the field emission array. Row lines typically extend across a field emission display substantially perpendicularly to the direction in which the column lines extend. Accordingly, the paths of a row line and of a column line typically cross proximate (above and below, respectively) the location of an emitter tip. The row lines of a field emission array are electrically connected to a relatively positive voltage source. Thus, as a voltage is applied across the column line and the row line, electrons are emitted by the emitter tips and accelerated through an opening in the row line.

As electrons are emitted by emitter tips and accelerate past the row line that extends over the pixel, the electrons are directed toward a corresponding pixel of a positively charged electro-luminescent panel of the field emission display, which is spaced apart from and substantially parallel to the field emission array. As electrons impact a pixel of the electro-luminescent panel, the pixel is illuminated. The degree to which the pixel is illuminated depends upon the number of electrons that impact the pixel.

An exemplary method of fabricating field emission arrays is taught in U.S. Pat. No. 5,372,973 (hereinafter "the '973 Patent"), issued to Trung T. Doan et al. on Dec. 13, 1994. The field emission array fabrication method of the '973 Patent includes an electrically conductive grid, or gate, disposed over the surface thereof and including apertures substantially above each of the emitter tips of the field emission array. Known processes, including chemical mechanical planarization ("CMP") and a subsequent mask and etch, are employed to provide a substantially planar grid surface and to define the apertures therethrough. While the electrically conductive grid of the field emission array disclosed in the '973 Patent is fabricated from an electrically conductive material such as chromium, field emission displays that include grids of semiconductive material, such as silicon, are also known.

Typically, in fabricating row lines over planarized field emission arrays that include grids of semiconductive material, three separate mask steps and subsequent etches are employed. With reference to FIGS. 1A and 2A, a first mask 28 is typically required to remove semiconductive material of grid 122 from the areas between adjacent rows of emitters tips 114 and thereby define row lines 132 of the remaining portions of the semiconductive grid 122 and expose regions of dielectric layer 120 between adjacent row lines 132. FIGS. 1B and 2B illustrate the use of a second mask 136 to remove conductive material 126, which is deposited over grid 122 of semiconductive material, from the areas between adjacent row lines 132 in order to further define row lines 132 through the conductive material 126, and from the portion of row lines 132 overlying each pixel 112 or emitter tip 114 in order to form pixel openings 140 that facilitate the travel of electrons emitted from emitter tips 114 through apertures 124 of grid 122 and past row lines 132. With reference to FIGS. 1C and 2C, a third mask 150 is required to remove passivation material 134 disposed over row lines 132 from pixel openings 140.

The use of three separate masks undesirably increases fabrication time and costs, as three separate photoresist deposition steps, three separate photoresist exposure steps, and three separate mask removal steps are required. Accordingly, row line fabrication processes that require three mask steps are somewhat inefficient.

Accordingly, there is a need for a field emission array row line fabrication method that requires fewer than three masks and, consequently, that increases the efficiency with which row lines are fabricated while reducing the likelihood of failure of the field emission arrays and the costs associated with fabricating field emission arrays.

SUMMARY OF THE INVENTION

The present invention includes a method of fabricating row lines on the planarized semiconductive grid of a field emission display. The row line fabrication method of the present invention employs two masks to define the row lines over the field emission array and pixel openings through the row lines.

According to the present invention, the column lines, emitter tips, overlying semiconductive grid, and apertures through the semiconductor grid above the emitter tips of a field emission array may be fabricated by known processes. The semiconductive grid of the field emission array may be planarized by known processes, such as by known chemical-mechanical planarization ("CMP") techniques. Each pixel of the field emission array may include one or more emitter tips, as known in the art.

A layer of conductive material may then be deposited over the substantially planar surface of the semiconductive grid of the field emission array. A first mask, including apertures alignable between adjacent rows of pixels of the field emission array, is employed to define row lines over the field emission array. The first mask, which may be fabricated by known processes, is disposed over the layer of conductive material. The conductive material that underlies the apertures of the first mask, that is located substantially within a periphery of each of the apertures, and that is exposed through the apertures of the first mask is then removed by known techniques, such as etching. Next, portions of the semiconductive grid that underlie the apertures of the first mask and are located substantially within a periphery of each of the apertures, and that are exposed, are removed, such as by known etching techniques. These portions of the semiconductive grid may be exposed either through the apertures of the first mask or through apertures that were defined through the previously etched layer of conductive material during the removal of conductive material therefrom. As portions of the semiconductive grid of the field emission array are removed, the row lines of the field emission array are defined and the underlying layer of passivation material beneath the semiconductive grid is exposed between adjacent row lines.

A layer of passivation material is then disposed over the surface of the field emission array, including over the row lines of the field emission array. As the conductive material of the row lines and the overlying layer of passivation material are disposed over the semiconductive grid and the field emitters of the field emission array, electrons are prevented from escaping the field emission array. Accordingly, a second mask is employed to define pixel openings through the conductive material of the row lines and through the overlying layer of passivation material.

The second mask, which includes apertures that are alignable over each of the pixels of the field emission array, may be fabricated and disposed over the field emission array as known in the art. After the second mask has been disposed over the field emission array, the passivation material underlying each of the apertures, located substantially within a periphery of each of the apertures, and exposed through the apertures may be removed by known processes, such as etching, to expose the underlying conductive material of the row lines. The conductive material that underlies each of the apertures of the second mask and that is located substantially within a periphery of each of the apertures is then exposed through the second mask or through the passivation layer and may be removed by known processes, such as etching, to expose the underlying semiconductive grid, including the apertures therethrough that are positioned substantially above pixels of the field emission array.

The field emission array may then be assembled with other components of a field emision display, such as the display screen, housing, and other components thereof, as known in the art.

Other features and advantages of the present invention will become apparent to those of skill the art through a consideration of the ensuing description, the accompanying drawings, and the appended claims.

DETAILED DESCRIPTION OF THE INVENTION

Figure 1A:
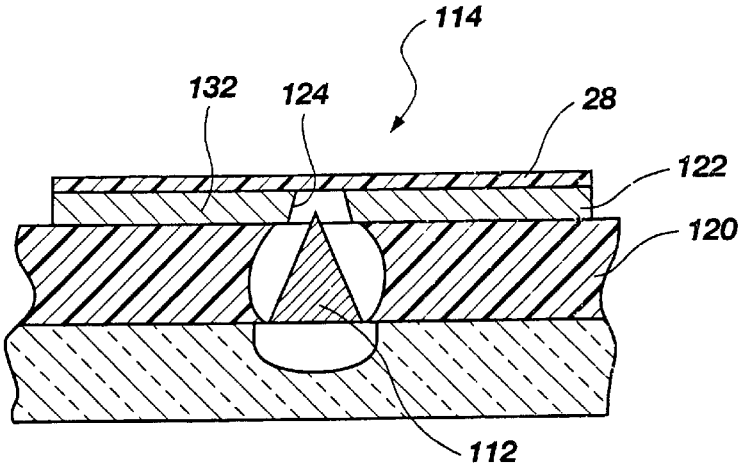
Fig. 1A (PRIOR ART)
FIGS. 1A–1C are cross-sectional schematic representations of a known three-mask step method of fabricating a row line over a pixel of a planarized field emission array.
Figure 2A:
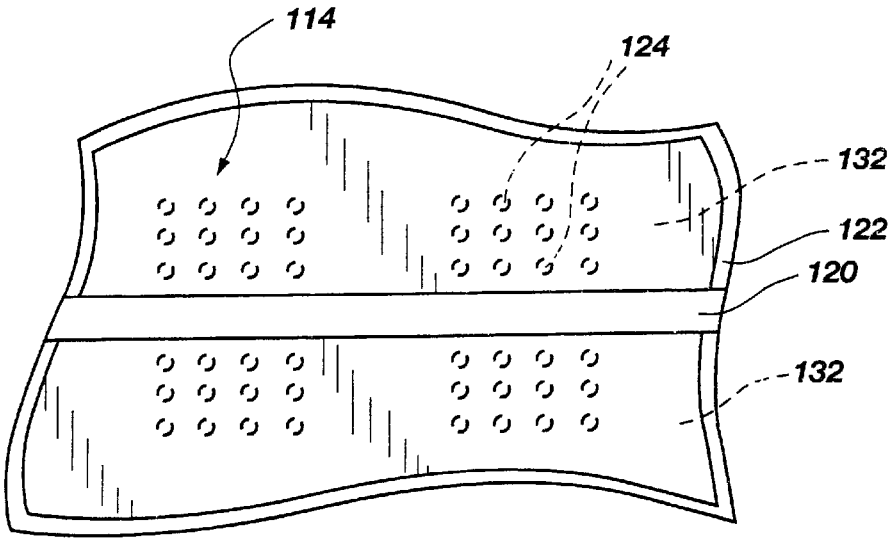
Fig. 2A (PRIOR ART)
FIGS. 2A–2C are top views that schematically illustrate the three-mask step method of FIGS. 1A–1C, respectively.
Figure 1B:
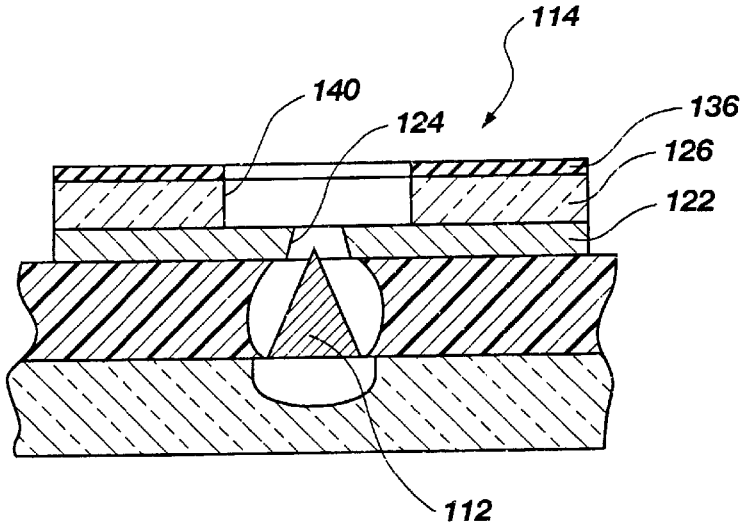
Fig. 1B (PRIOR ART)
Figure 2B:
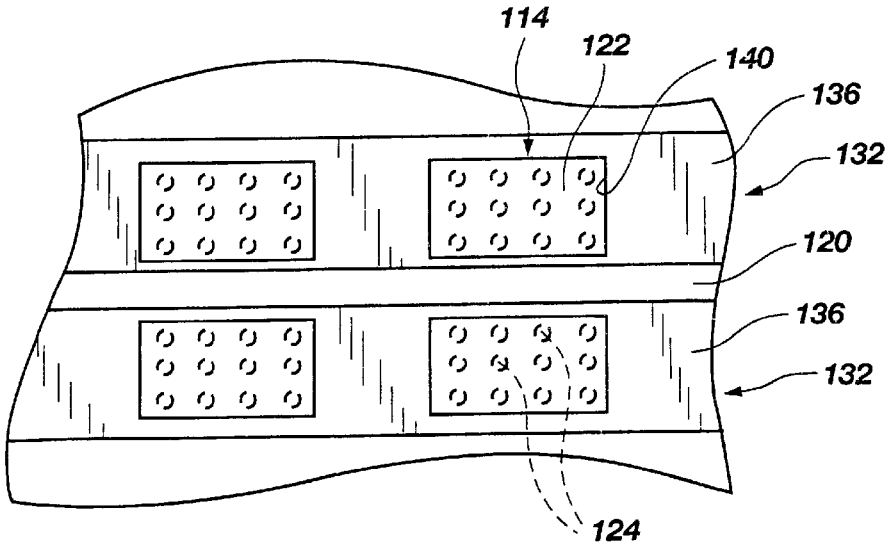
Fig. 2B (PRIOR ART)
Figure 1C:
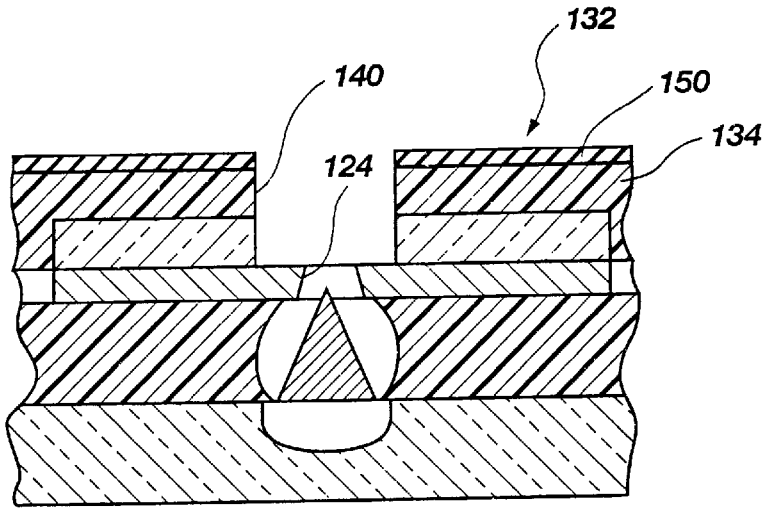
Fig. 1C (PRIOR ART)
Figure 2C:
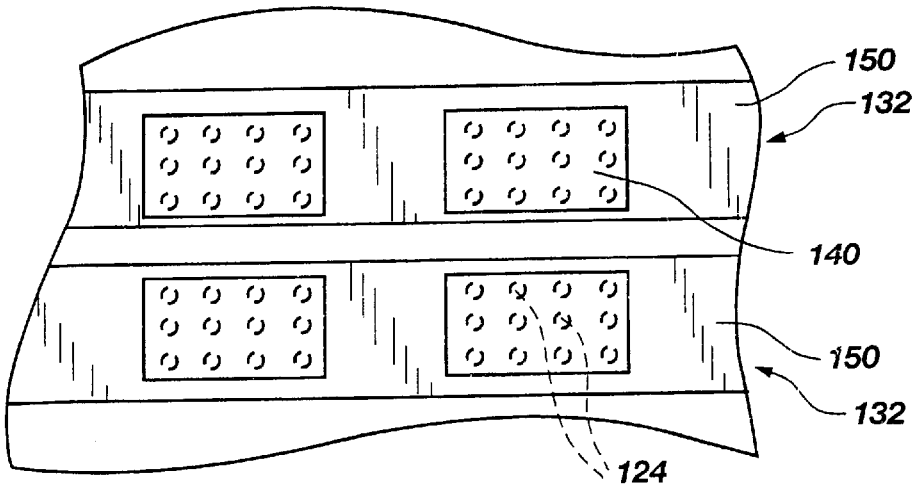
Fig. 2C (PRIOR ART)
Figure 3A:
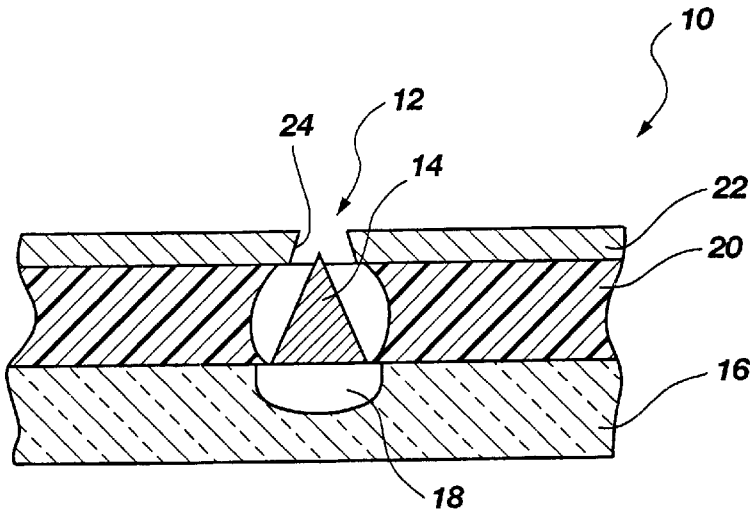
FIG. 3A is a cross-sectional schematic representation of a pixel of a planarized field emission array upon which row lines may be fabricated in accordance with the method of the present invention.
Figure 3B:
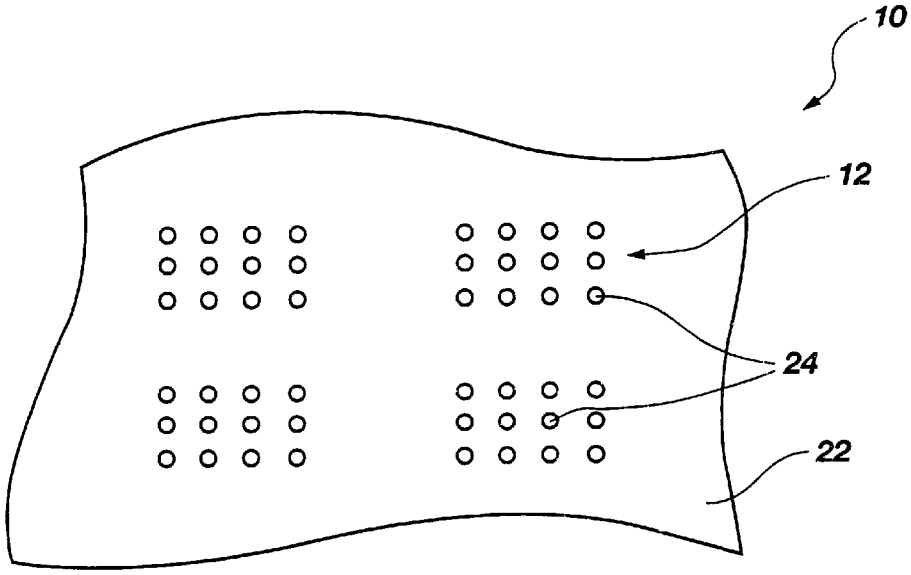
FIG. 3B is a top view that schematically illustrates a field emission array such as that shown in FIG. 3A, wherein each of the pixels includes a plurality of emitter tips.

With reference to FIGS. 3A and 3B, a pixel 12 of a field emission array 10 is illustrated. While FIG. 3A depicts a pixel 12 including only a single emitter tip 14, FIG. 3B depicts a pixel 12 that includes several emitter tips. Field emission array 10 also includes a semiconductor substrate 16 with a column line 18 in electrical communication with emitter tip 14 and substantially all other emitter tips within the same column as emitter tip 14. A dielectric layer 20 is disposed laterally adjacent emitter tip 14. A grid 22 of semiconductive material is disposed over dielectric layer 20 and includes an aperture 24 therethrough located substantially above emitter tip 14.

Column line 18, dielectric layer 20, emitter tip 14, and grid 22 may be fabricated as known in the art. An exemplary method of fabricating these structures of a field emission array is disclosed in U.S. Pat. No. 5,372,973 (hereinafter "the '973 Patent"), which issued to Trung T. Doan on Dec. 13, 1994, the disclosure of which is hereby incorporated in its entirety by this reference. As disclosed in the '973 Patent, grid 22 is preferably planarized, such as by known chemical-mechanical planarization ("CMP") techniques, such as those disclosed in U.S. Pat. No. 4,193,226 and 4,811,522, the disclosures of each of which are hereby incorporated in their entirety by this reference. The grid of the '973 Patent, however, is a doped polysilicon (i.e., electrically conductive) grid rather than a semiconductive grid.

Figure 4A:
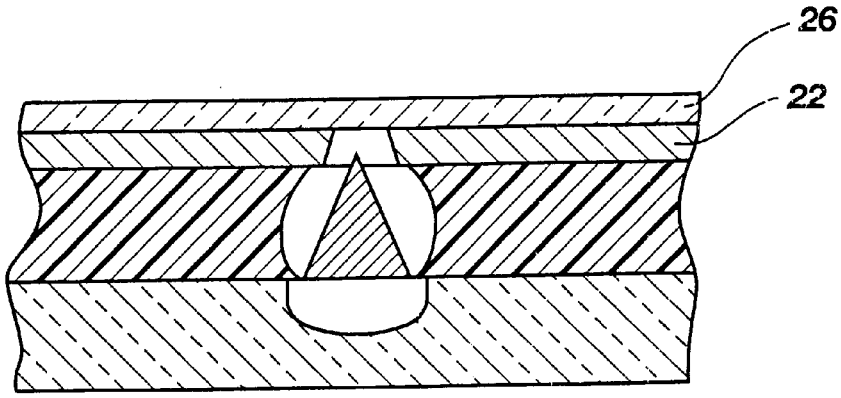
FIGS. 4A and 4B schematically illustrate the disposition of a layer of conductive material over the field emission arrays of FIGS. 3A and 3B, respectively.
Figure 4B:
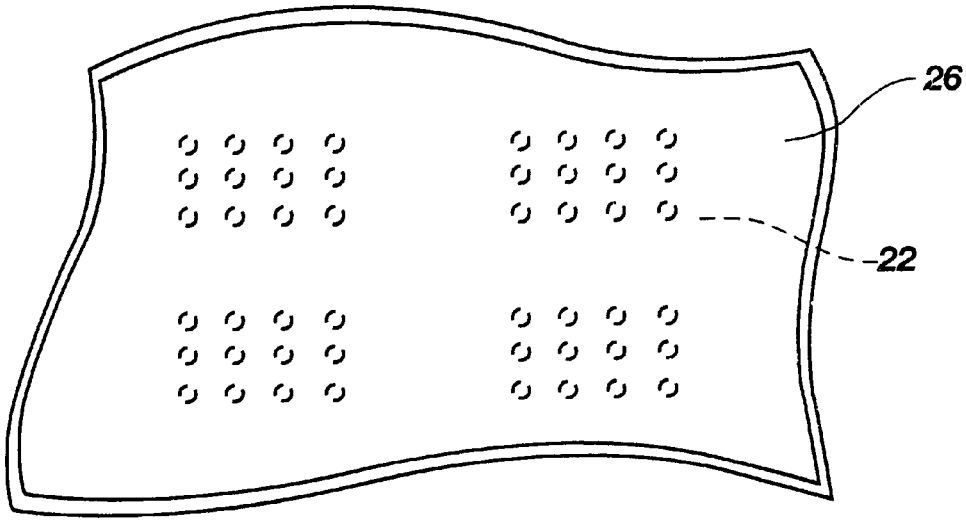

Referring now to FIGS. 4A and 4B, the method of the present invention includes disposing a layer 26 of conductive material, which is also referred to herein as a conductive layer or as a first layer, over grid 22. Layer 26 may be fabricated from doped polysilicon, chromium, molybdenum, aluminum, or other materials that may be employed as electrically conductive traces in semiconductor or field emission array fabrication processes. The conductive material of layer 26 may be deposited by known techniques, including, without limitation, by physical vapor deposition ("PVD") (e.g., sputtering) or by chemical vapor deposition ("CVD"), including, without limitation, low-pressure CVD ("LPCVD"), plasma-enhanced CVD ("PECVD"), and atmospheric pressure CVD ("APCVD").

Figure 5A:
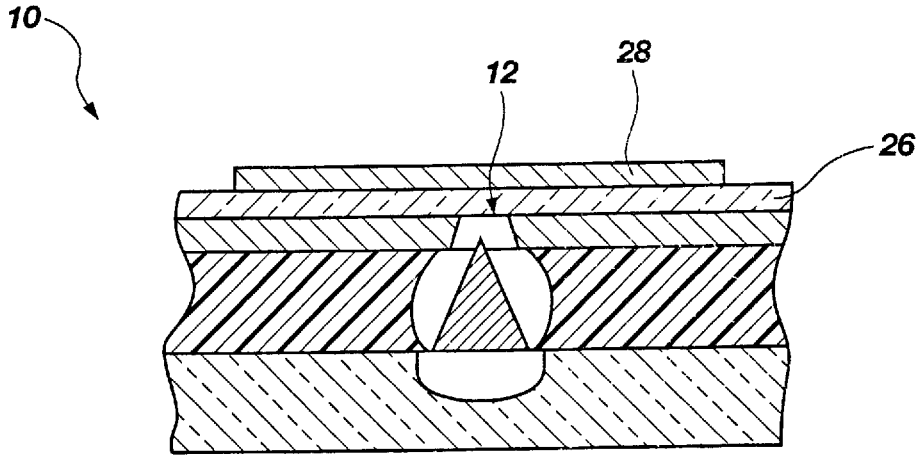
FIGS. 5A and 5B schematically illustrate the disposition of a first mask over the field emission arrays of FIGS. 4A and 4B, respectively.
Figure 5B:
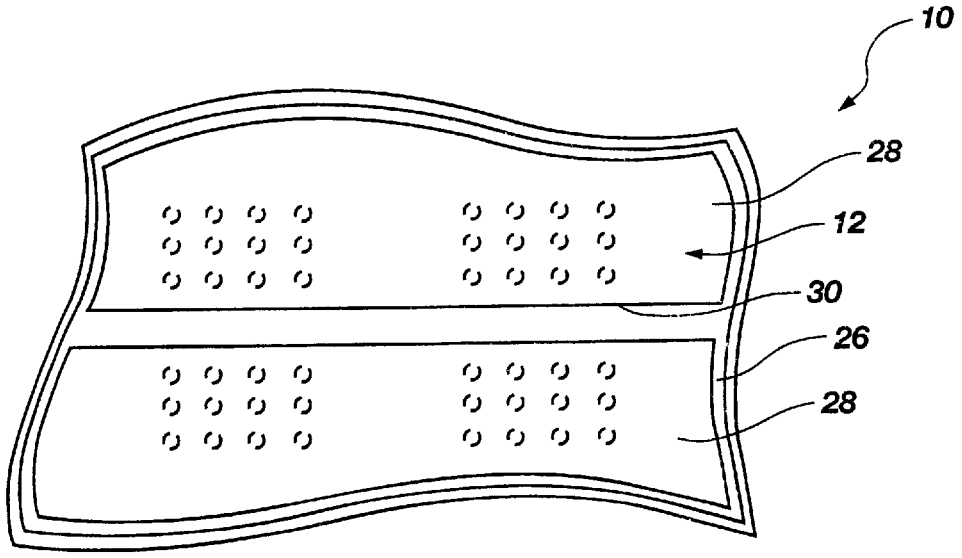

Turning to FIGS. 5A and 5B, a mask 28, which is also referred to herein as a first mask, is disposed over layer 26. Mask 28 includes apertures 30 therethrough that are alignable between adjacent rows of pixels 12 of field emission array 10. Mask 28 may be fabricated as known in the art, such as by disposing a layer of photoresist material over layer 26 and exposing and developing selected regions of the layer of photoresist material to define mask 28 and apertures 30 therethrough.

Figure 6A:
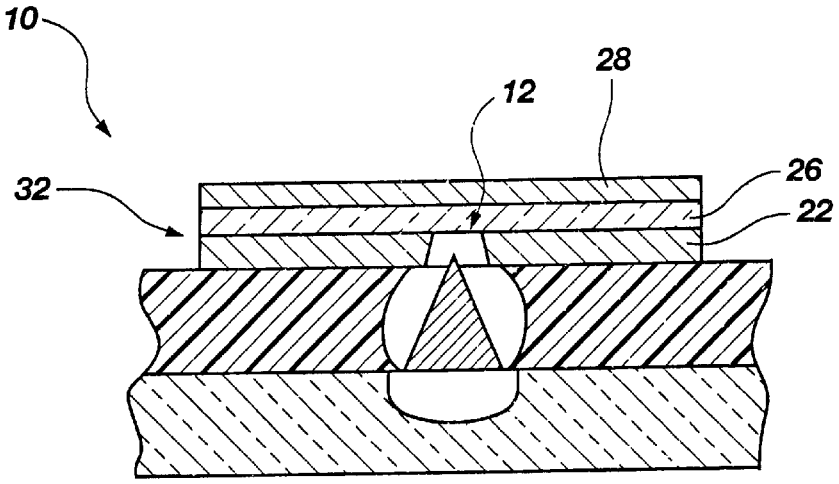
FIGS. 6A and 6B schematically illustrate the removal of conductive material and semiconductive material, as facilitated by the apertures of the first mask, to define row lines of the field emission arrays of FIGS. 5A and 5B, respectively.
Figure 6B:
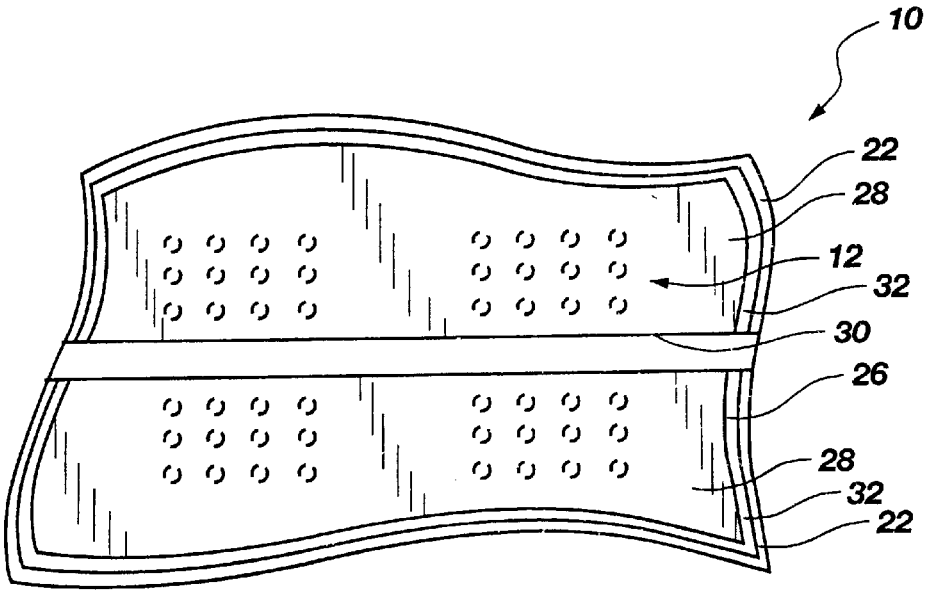

FIGS. 6A and 6B illustrate removal of the conductive material of layer 26 and the semiconductive material of grid 22 to define row lines 32 over rows of pixels 12 or rows of emitter tips 14 of field emission array 10. Either wet etch or dry etch processes and etchants may be employed to remove conductive material from layer 26 and semiconductive material from grid 22. When dry etchants are employed in the method of the present invention, known dry etch techniques, such as glow-discharge sputtering, ion milling, reactive ion etching ("RIE"), reactive ion beam etching ("RIBE"), and high-density plasma etching, may be employed to etch the conductive material of layer 26 and the semiconductive material of grid 22.

Preferably, a first etchant is employed to remove conductive material of layer 26 exposed through apertures 30 and a second etchant is employed to subsequently remove the semiconductive material of grid 22 that is exposed through apertures 30 or through the areas of layer 26 from which conductive material was previously removed. The first etchant may be either a dry etchant or a wet etchant. An exemplary, known polysilicon dry etchant (i.e., first etchant) that exhibits good selectivity for polysilicon over single-crystalline silicon includes a combination of $SF_6$ and $C_2$. If molybdenum is employed as the conductive material of layer 26, a known molybdenum etchant, such as the dry etchants $CF_4$, $SF_4$, or $SF_6$, could be employed. Of course, if layer 26 comprises one or more other types of conductive material, known wet or dry etchants for each of these types of conductive materials may be employed in the method of the present invention.

The second etchant, which is employed to etch a semiconductive material such as silicon, may also be a dry etchant or a wet etchant. Silicon dry etchants that may be employed in the method of the present invention include, without limitation, $BCl_3$, $CCl_4$, $Cl_2$, $SiCl_4$, $CF_4$, $SF_4$, and $SF_6$. Other appropriate known etchants may be employed if the semiconductive material of grid 22 comprises semiconductive materials other than silicon.

Alternatively, etchants, such as fluorine-rich silicon dry etchants, with selectivity over doped silicon oxides (e.g., glass) and undoped silicon oxides could be employed to etch both electrically conductive doped polysilicon (i.e., the conductive material) of layer 26 and silicon (i.e., the semiconductive material) of grid 22.

As another alternative, known wet etchants may be employed in conjunction with known wet etch processes to selectively remove the conductive material of layer 26 and the semiconductive material of grid 22 from the desired regions of field emission array 10.

After row lines 32 have been defined, or after the selective removal of a portion of each of layer 26 and grid 22, the etchant or etchants may be removed from field emission array 10. Mask 28 may be removed from layer 26 by known techniques, such as by washing field emission array 10 either following the removal of conductive material from layer 26 or after the removal of semiconductive material from grid 22.

Figure 7A:
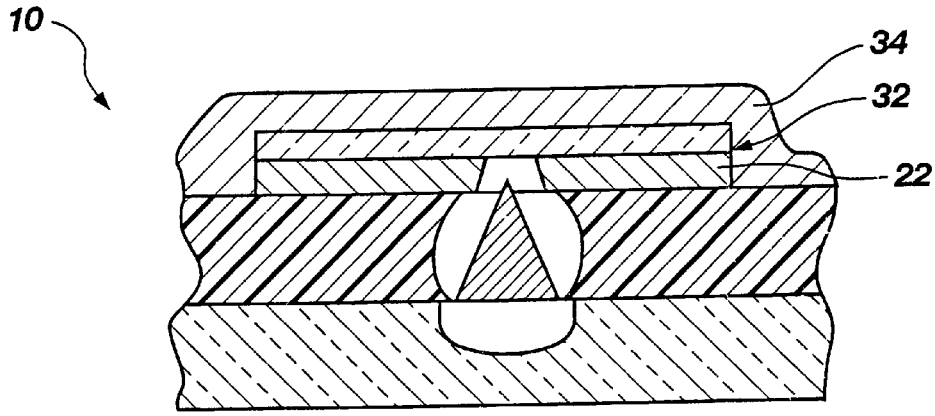
FIGS. 7A and 7B schematically illustrate the formation of a passivation layer over the surface of the field emission arrays of FIGS. 6A and 6B, respectively.
Figure 7B:
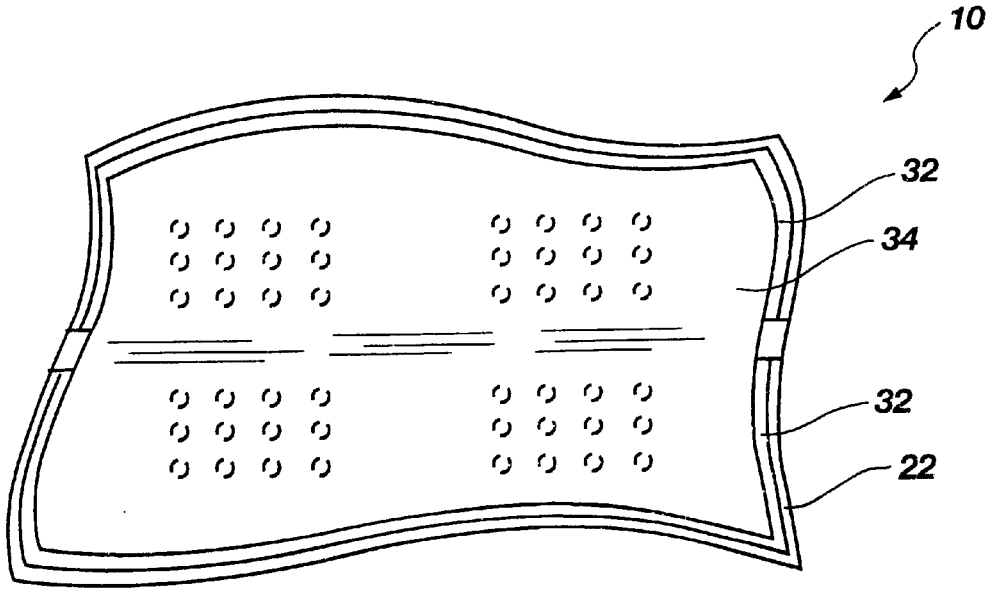

Referring to FIGS. 7A and 7B, a layer 34 of passivation material, which is also referred to herein as a passivation layer or as a second passivation layer, is disposed at least over row line 32. Layer 34 may be selectively deposited over row line 32, or may be blanket deposited over field emission array 10 by known processes. The passivation material of layer 34 may comprise glass, such as borophosphosilicate glass ("BPSG"), phosphosilicate glass ("PSG"), or borosilicate glass ("BSG"), silicon oxides, other oxides, silicon nitrides, or other passivation materials that may be employed in fabricating semiconductor devices or field emission arrays. Layer 34 may be fabricated by known processes, such as by glass deposition techniques (e.g., CVD or spin-on glass ("SOG") processes), by growing an oxide layer over the exposed surface of field emission array 10, or by TEOS deposition processes or silicon nitride deposition processes.

Figure 8A:
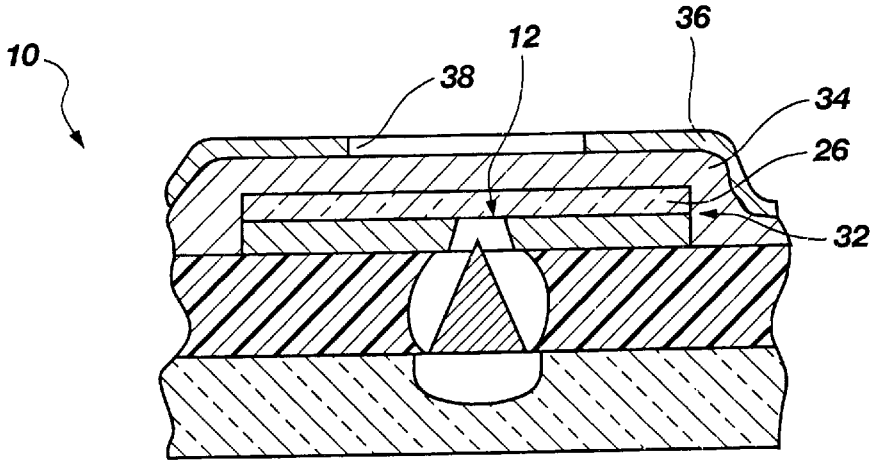
FIGS. 8A and 8B schematically illustrate the disposition of a second mask over the field emission arrays of FIGS. 7A and 7B, respectively.
Figure 8B:
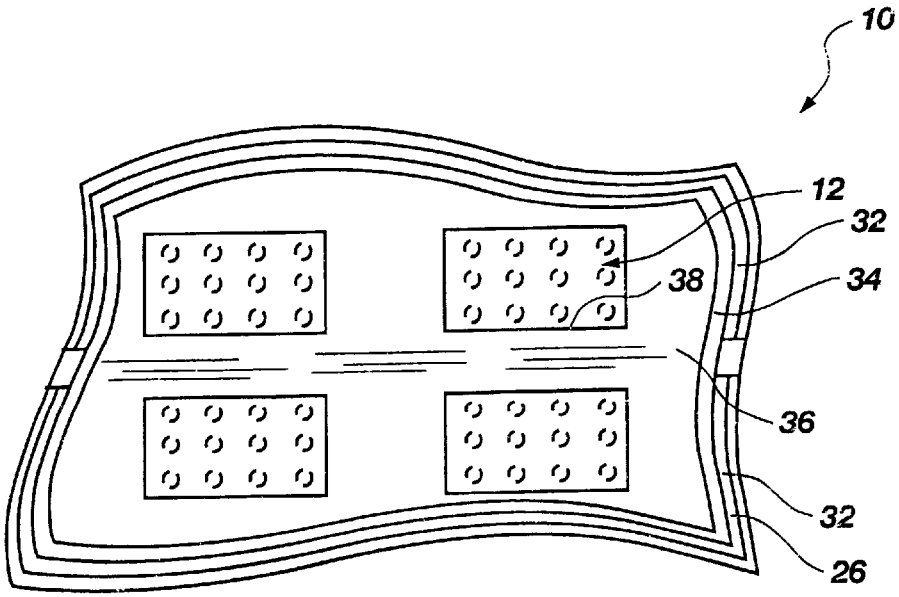

FIGS. 8A and 8B illustrate the disposal of another mask 36, which is also referred to herein as a second mask, over layer 34. Mask 36 includes apertures 38, which are also referred to herein as second apertures, alignable over pixels 12 of field emission array 10 as mask 36 is aligned with and positioned upon layer 34. Mask 36 and apertures 38 may be defined by known processes, such as disposing a layer of photoresist material over layer 34 and exposing and developing the photoresist material to define apertures 38 in the appropriate locations of mask 36.

Figure 9A:
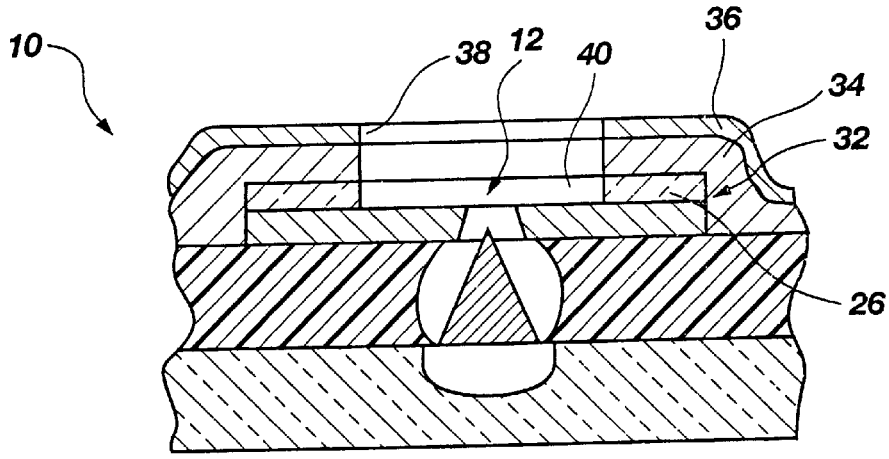
FIGS. 9A and 9B schematically illustrate the removal of passivation material and conductive material, as facilitated by the apertures of the second mask, to define pixel openings over the pixels of the field emission arrays of FIGS. 8A and 8B, respectively.
Figure 9B:
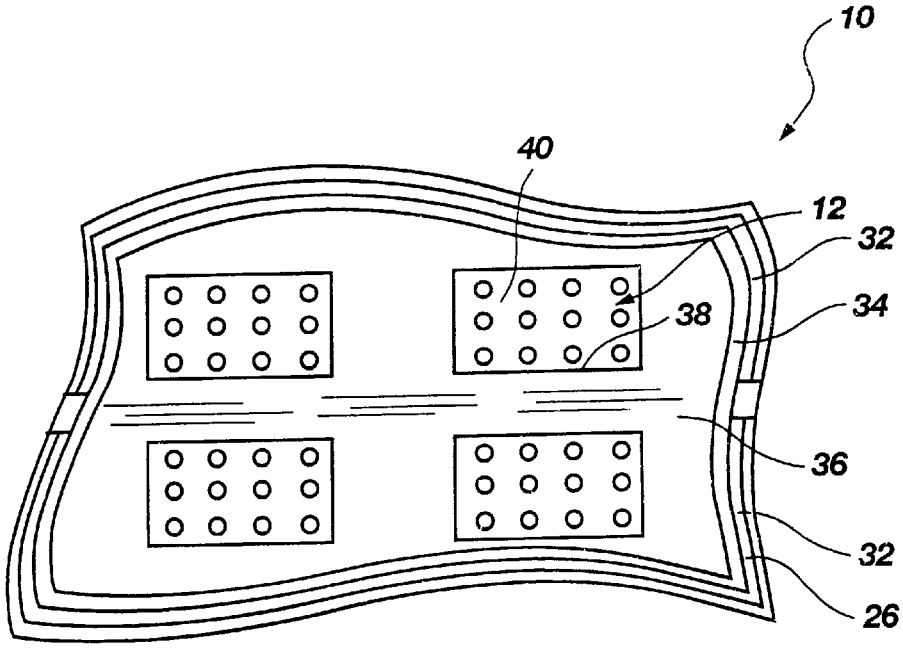

Turning to FIGS. 9A and 9B, a pixel opening 40 may be defined through the passivation material of layer 34 and through the conductive material of layer 26 of row line 32 by removing the passivation material and the conductive material at the desired location of the pixel opening 40 through apertures 38 of mask 36. Known etching techniques may be employed to remove passivation material of layer 34 and conductive material of layer 26 in order to define pixel opening 40 through aperture 38 and to expose grid 22 through pixel opening 40. Either wet etch techniques and etchants or dry etch techniques and etchants may be employed.

For example, known dry etch processes, such as those disclosed above in reference to FIGS. 6A and 6B may be employed to remove passivation material of layer 34 in order to define pixel openings 40. Exemplary dry etchants that may be employed to remove a silicon oxide comprised passivation material of layer 34 that is exposed through aperture 38 without substantially etching the semiconductive material of the underlying grid 22 include, without limitation, known chlorine and fluorine dry etchants (e.g., $BCl_3$, $CCl_4$, $Cl_2$, $SiCl_4$, $CF_4$, $CHF_3$, $C_2F_6$, $C_3F_8$, etc.). Of course, if silicon nitride is employed as a passivation material of layer 34, known silicon nitride dry etchants, such as $CF_4$—$O_2$ or $NF_3$, may be employed to remove the silicon nitride from the desired regions of layer 34. Alternatively, known wet etch processes and wet etchants may be employed to remove passivation material from the desired regions of layer 34.

Exemplary etchants that may be employed to remove conductive material of layer 26 exposed through aperture 38 following the removal of the overlying passivation material of layer 34 include the doped polysilicon etchants and molybdenum etchants disclosed above in reference to FIGS. 6A and 6B, which may be employed in the dry etch processes disclosed above in reference to FIGS. 6A and 6B. Of course, if another conductive material is used in layer 26, dry etchants for that material may be employed. Alternatively, known wet etchants may be employed in conjunction with known wet etch processes to remove the conductive material from desired regions of layer 26.

After pixel openings 40 have been defined, known techniques, such as washing, may be employed to terminate etching or to remove the etchants from field emission array 10.

Figure 10A:
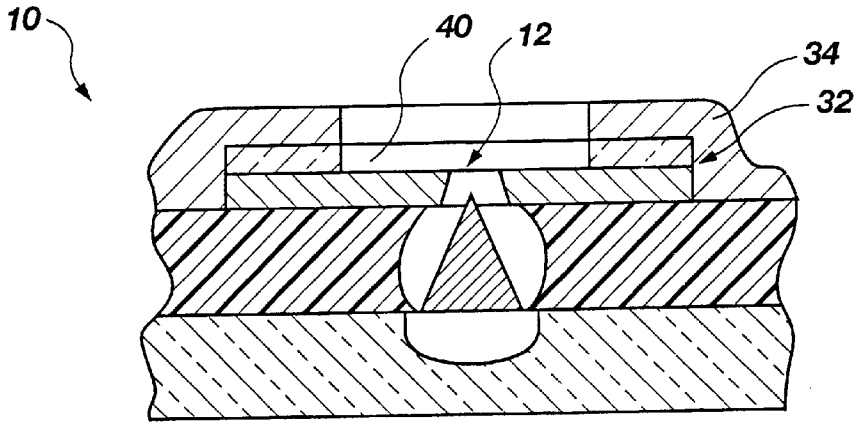
FIGS. 10A and 10B schematically illustrate a field emission array including row lines extending over the surface thereof that were fabricated in accordance with the method of the present invention.
Figure 10B:
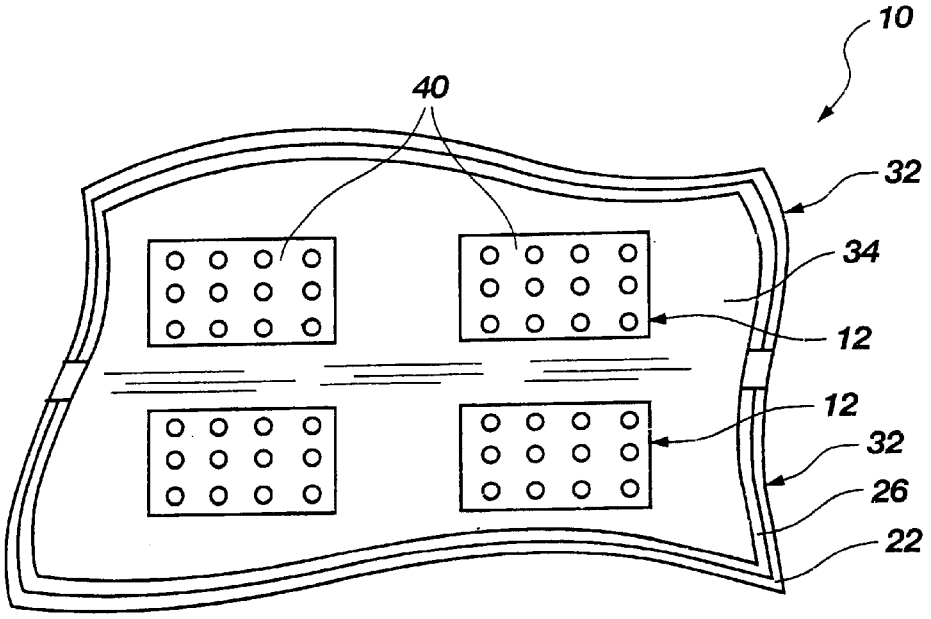

FIGS. 10A and 10B illustrate a field emission array 10 that includes row lines 32 and pixel openings 40 through the row lines, which have been fabricated in accordance with the method of the present invention.

As the method of the present invention only requires two masks, including a first mask to define row lines 32 and a second mask to define pixel openings 40, the method may be more efficient than conventional processes for fabricating row lines and their pixel openings over the planarized semiconductor grids of field emission arrays. Thus, the method of the present invention may decrease the failure rates and fabrication costs of field emission arrays.

Although the foregoing description contains many specifics and examples, these should not be construed as limiting the scope of the present invention, but merely as providing illustrations of some of the presently preferred embodiments. Similarly, other embodiments of the invention may be devised which do not depart from the spirit or scope of the present invention. The scope of this invention is, therefore, indicated and limited only by the appended claims and their legal equivalents, rather than by the foregoing description. All additions, deletions and modifications to the invention as disclosed herein and which fall within the meaning of the claims are to be embraced within their scope.

What is claimed is:

1. An emission device, comprising:

at least one emitter tip;

a dielectric layer laterally adjacent said at least one emitter tip; and at least one row line including:

a semiconductive layer through which at least a portion of said at least one emitter tip is exposed;

a conductive material disposed over said semiconductive layer through which said at least one emitter tip is exposed; and a passivation layer over said conductive material and through which said at least one emitter tip is exposed, said at least one row line extending over said at least one emitter tip, said dielectric layer and said passivation layer contacting one another laterally adjacent to said at least one emitter tip.

2. The emission device of claim 1, wherein said dielectric layer comprises silicon oxide, silicon nitride, borophosphosilicate glass, borosilicate glass, or phosphosilicate glass.

3. The emission device of claim 1, wherein said conductive material comprises metal or polysilicon.

4. The emission device of claim 1, wherein said semiconductive layer comprises silicon.

5. The emission device of claim 1, wherein said passivation layer comprises silicon oxide, silicon nitride, borophosphosilicate glass, borosilicate glass, or phosphosilicate glass.

6. The emission device of claim 1, comprising a plurality of emitter tips.

7. The emission device of claim 6, wherein said dielectric layer and said passivation layer contact one another between adjacent emitter tips of said plurality of emitter tips.

8. The emission device of claim 6, wherein said plurality of emitter tips is arranged in an array.

9. The emission device of claim 8, wherein said array comprises an area array.

10. The emission device of claim 9, wherein said area array comprises a plurality of rows.

11. The emission device of claim 10, wherein said at least one row line is positioned over a row of emitter tips of said plurality of rows.

12. The emission device of claim 10, wherein said dielectric layer and said passivation layer contact one another at locations between adjacent rows of said plurality of rows.

13. The emission device of claim 1, further comprising at least one pixel including said at least one emitter tip.

14. The emission device of claim 13, wherein said at least one pixel includes a plurality of emitter tips.

15. The emission device of claim 14, wherein said at least one row line is positioned over said at least one pixel.

16. A row line of an emission device that includes at least one emitter tip and a dielectric layer laterally adjacent to the at least one emitter tip, comprising:

a semiconductive layer through which at least a portion of the at least one emitter tip is exposed;

a conductive material disposed over said semiconductive layer through which the at least one emitter tip is exposed; and a passivation layer over said conductive material and through which the at least one emitter tip is exposed, said passivation layer contacting the dielectric layer of the emission device at a location laterally adjacent to the at least one emitter tip.

17. The row line of claim 16, wherein the dielectric layer and said passivation layer contact one another at locations laterally adjacent said row line.

18. The row line of claim 16, further comprising at least one aperture through which at least a portion of the at least one emitter tip is exposed, said at least one aperture extending through each of said semiconductive, conductive, and passivation layers.

19. The row line of claim 18, further comprising a plurality of apertures.

20. The row line of claim 19, wherein a group of apertures of said plurality of apertures corresponds to a group of emitter tips of a pixel of the emission device.

* * * * *

UNITED STATES PATENT AND TRADEMARK OFFICE

CERTIFICATE OF CORRECTION

PATENT NO. : 6,559,581 B2
APPLICATION NO. : 10/108973
DATED : May 6, 2003
INVENTOR(S) : Ammar Derraa It is certified that error appears in the above-identified patent and that said Letters Patent is hereby corrected as shown below:

In the drawings:

| | |
|---|---|
| In FIG. 5A, | insert reference numeral --30-- and lead line therefor |
| In FIG. 6A, | insert reference numeral --14-- and lead line therefor |
| In FIG. 9A, | insert reference numeral --22-- and lead line therefor |

| | |
|---|---|
| COLUMN 2, LINE 7, | change “emitters tip” to --emitter tip-- |

UNITED STATES PATENT AND TRADEMARK OFFICE

CERTIFICATE OF CORRECTION

PATENT NO. : 6,559,581 B2
APPLICATION NO. : 10/108973
DATED : May 6, 2003
INVENTOR(S) : Ammar Derraa It is certified that error appears in the above-identified patent and that said Letters Patent is hereby corrected as shown below:

Please replace FIG. 5A with the following drawing:

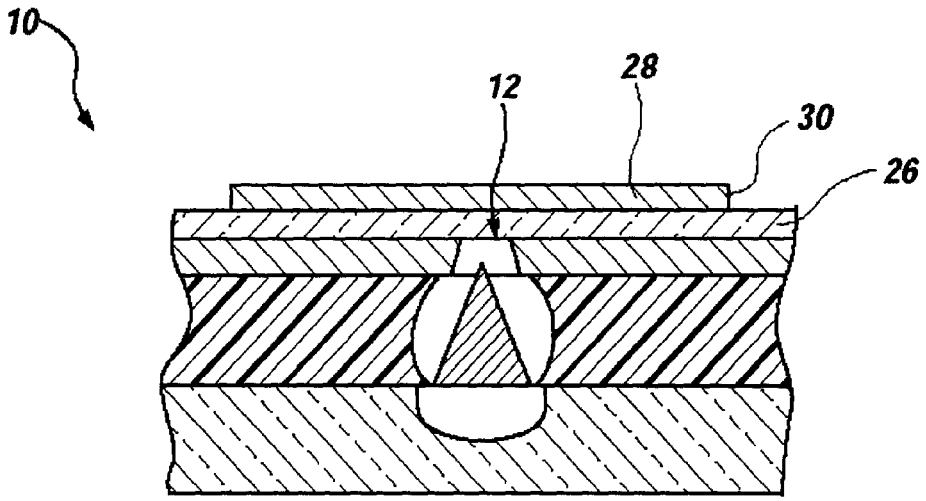

*Fig. 5A*

UNITED STATES PATENT AND TRADEMARK OFFICE

CERTIFICATE OF CORRECTION

PATENT NO. : 6,559,581 B2
APPLICATION NO. : 10/108973
DATED : May 6, 2003
INVENTOR(S) : Ammar Derraa It is certified that error appears in the above-identified patent and that said Letters Patent is hereby corrected as shown below:

Please replace FIG. 6A with the following drawing:

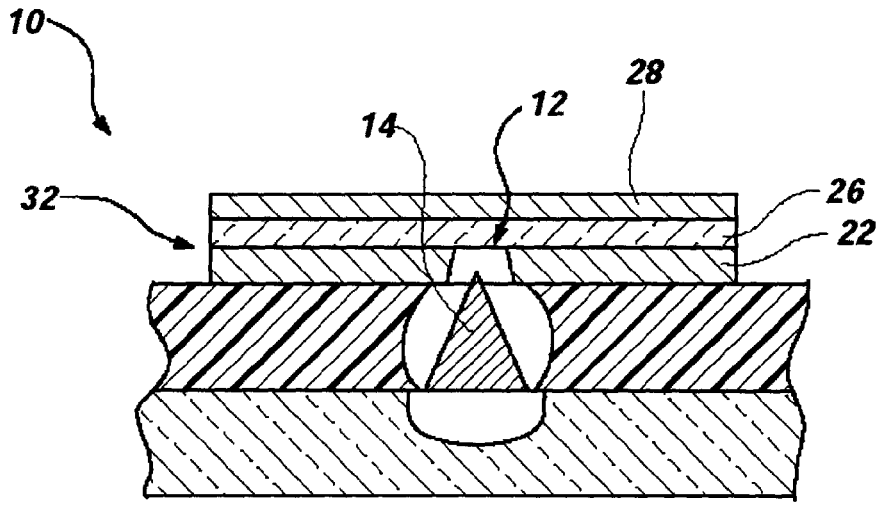

*Fig. 6A*

UNITED STATES PATENT AND TRADEMARK OFFICE

CERTIFICATE OF CORRECTION

PATENT NO. : 6,559,581 B2
APPLICATION NO. : 10/108973
DATED : May 6, 2003
INVENTOR(S) : Ammar Derraa It is certified that error appears in the above-identified patent and that said Letters Patent is hereby corrected as shown below:

Please replace FIG. 9A with the following drawing:

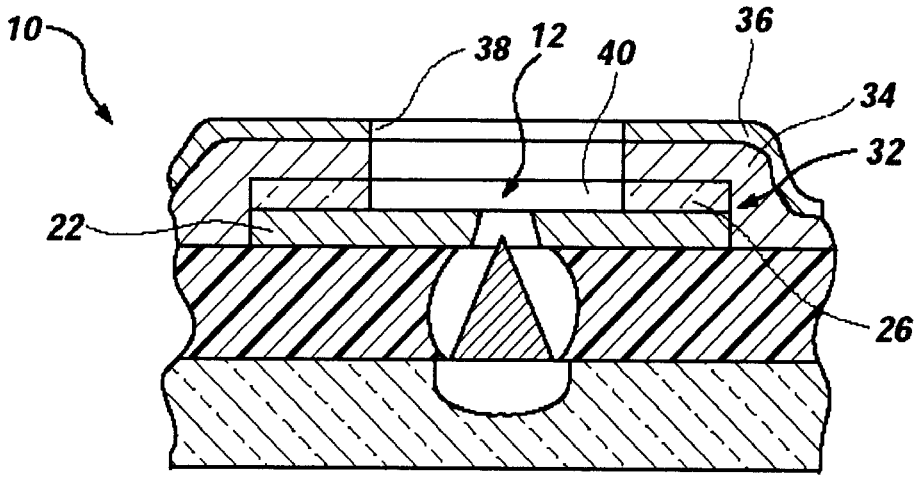

*Fig. 9A*

Signed and Sealed this

Tenth Day of October, 2006

JON W. DUDAS
*Director of the United States Patent and Trademark Office*